US005809365A

United States Patent [19]

Yoshizawa

[11] Patent Number: 5,809,365

[45] Date of Patent: Sep. 15, 1998

[54] IMAGE FORMING APPARATUS USING INTERMEDIATE TRANSFER MEMBER

[75] Inventor: Ryuichi Yoshizawa, Numazu, Japan

[73] Assignee: Canon Kabushiki Kaisha, Tokyo, Japan

[21] Appl. No.: 907,047

[22] Filed: Aug. 6, 1997

[30] Foreign Application Priority Data

Aug. 7, 1996 [JP] Japan ..... 8-208237

[51] Int. Cl.[6] ..... G03G 15/00

[52] U.S. Cl. ..... 399/31; 399/49; 399/302

[58] Field of Search ..... 399/24, 31, 49, 399/302, 308

[56] References Cited

U.S. PATENT DOCUMENTS 4,705,388 11/1987 Huntjens et al. ..... 399/24

FOREIGN PATENT DOCUMENTS 6-295111 10/1994 Japan .

8-44122 2/1996 Japan .

*Primary Examiner*—Joan H. Pendegrass

*Attorney, Agent, or Firm*—Fitzpatrick, Cella, Harper & Scinto

[57] ABSTRACT

The present invention provides an image forming apparatus for forming a toner image on a transfer material by using an intermediate transfer member, comprising an image bearing member, a toner image forming means for forming a toner image on the image bearing member, an intermediate transfer member moving along an endless path while contacting with the image bearing member, a measuring means for measuring a color of the intermediate transfer member, a judge means for judging a toner contaminated condition of the intermediate transfer member on the basis of a measured result by the measuring means, and a display means for displaying a judged result by the judge means. With this arrangement, by detecting the contamination of the intermediate transfer member and by displaying the contamination condition, both of deterioration of image quality due to toner contamination of the intermediate transfer member and reduction of a function for automatically setting an image forming condition can be prevented.

8 Claims, 6 Drawing Sheets

IMAGE FORMING APPARATUS USING INTERMEDIATE TRANSFER MEMBER

BACKGROUND OF THE INVENTION

1. Field of the Invention

The present invention relates to an image forming apparatus of electrophotographic type or electrostatic recording type such as a copying machine, a printer and the like. More particularly, it relates to an image forming apparatus in which a plurality of color images formed on an intermediate transfer member are successively transferred onto a recording material in a superimposed fashion to obtain a full-color image.

2. Related Background Art

In image forming apparatuses in which a plurality of developing devices supported by a rotatable support member are revolved to bring a selected developing device to a developing position so that a latent image formed on an intermediate transfer member is developed by the selected developing device, if the surface of the intermediate transfer member is smudged due to environmental conditions and/or operational conditions (for example, number of prints to be obtained), density of an image will be changed to result in obtaining the correct color tones impossible. To obtain the correct color tones, test toner images (for each color density detection) are formed on the intermediate transfer member to automatically detect the densities of the test images, and, then, the detected results are fed-back to image forming conditions such as an exposure amount, developing bias and the like to control the density of the image, to thereby obtain the correct color image.

However, if the contamination of the intermediate transfer member is increased, the density control will become difficult and the correct color tones could not be obtained. If the intermediate transfer member is smudged or contaminated to the extent that the density control becomes impossible, to obtain the correct color tones again, the smudged intermediate transfer member must be changed to a new one. However, in the prior art, there was provided no means for indicating the contamination of the intermediate transfer member to the operator or user.

SUMMARY OF THE INVENTION

An object of the present invention is to provide an image forming apparatus in which a service life of an intermediate transfer member or an electrophotographic photosensitive member as an image bearing member can be judged.

To achieve the above object, according to the present invention relating to an image forming apparatus in which a toner image is formed on a transfer material by using an intermediate transfer member, an image bearing member, a toner image forming means for forming a toner image on the image bearing member, an intermediate transfer member moved along an endless path while contacting with the image bearing member, a first bias applying means for generating first transfer bias between the image bearing member and the intermediate transfer member to effect primary transferring of the toner image formed on the image bearing member onto the intermediate transfer member at a first transfer position of the intermediate transfer member, a second bias applying means for generating second transfer bias between the intermediate transfer member and a transfer means to effect secondary transferring of the toner image transferred to the intermediate transfer member onto the transfer material at a second transfer position of the intermediate transfer member, a measuring means for measuring a color of the intermediate transfer member, a judge means for judging a toner contamination condition of the intermediate transfer member on the basis of a measured result from the measuring means, and a display means for displaying a judged result from the judge means, are provided.

DETAILED DESCRIPTION OF THE PREFERRED EMBODIMENTS

[First Embodiment]

Figure 1:
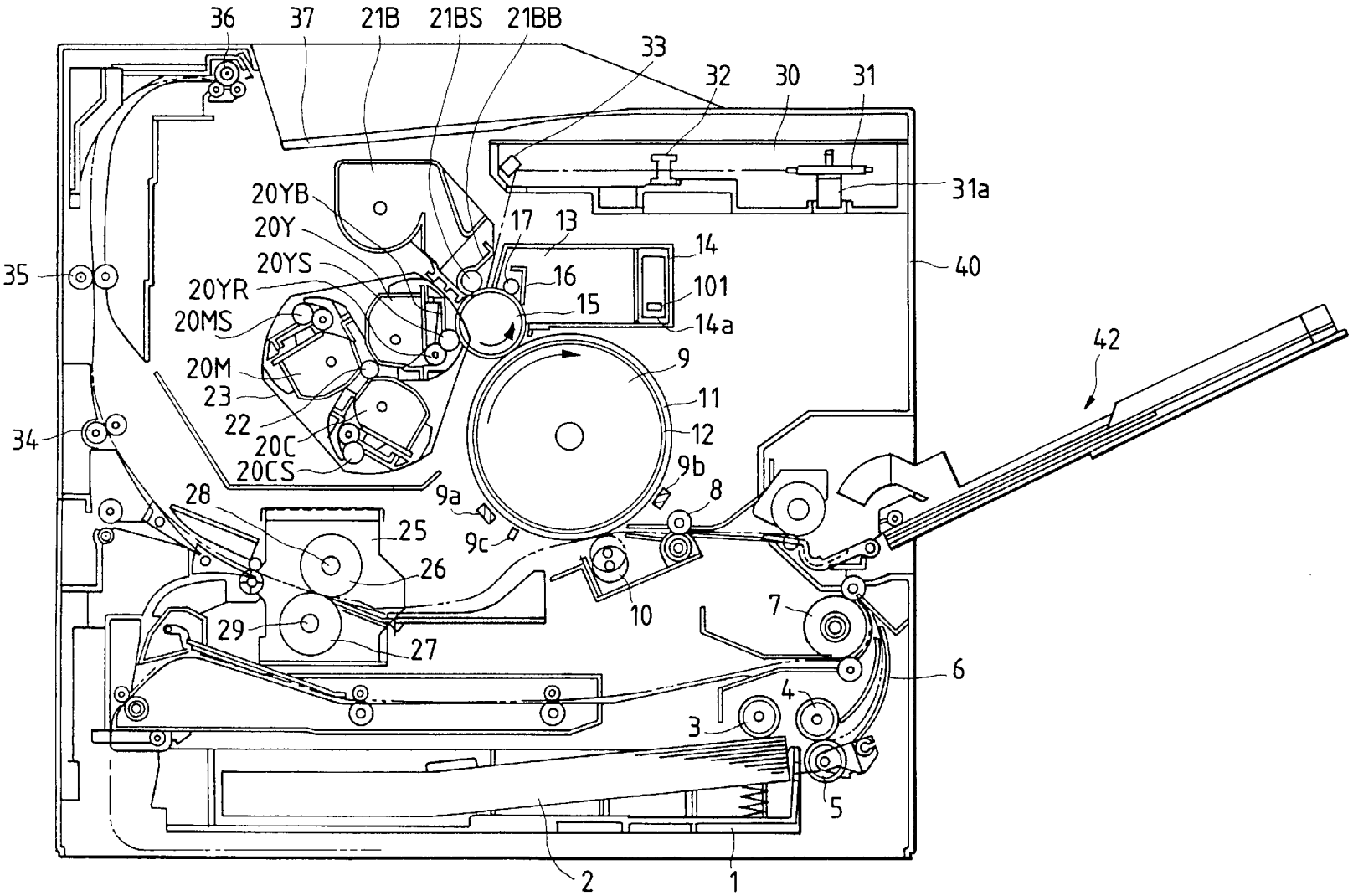
FIG. 1 is an elevational sectional view of a laser printer as a color image forming apparatus according to a first embodiment of the present invention.

As shown in FIG. 1, in a laser printer according to the present invention, an electrostatic latent image is formed at an image forming portion by image light obtained on the basis of an image signal scanning an original, the electrostatic latent image is developed as a visible color toner image. The color toner images so formed are successively transferred in a superimposed fashion to form a full-color image which is in turn transferred onto a transfer material 2. Then, the full-color image transferred to the transfer material 2 is fixed to the transfer material. The image forming portion includes a photosensitive member unit (drum unit) 13, a charge roller 17 of close contact type (first charge means), a cleaning means, a developing means, an intermediate transfer member 9, a sheet supply portion, a transfer portion and a fixing portion 25.

The drum unit 13 is constituted by a photosensitive drum or photosensitive member (image bearing member) 15, and a cleaner container 14 of the cleaning means which also acts as a holder for the photosensitive drum 15. The drum unit 13 is detachably supported by a frame of the printer so that the drum unit can easily be exchanged to a new one when a service life of the photosensitive drum 15 is expired. The photosensitive drum 15 is constituted by an aluminium cylinder and an organic photo-conductive layer coated on the aluminium cylinder, and is rotatably supported by the cleaner container 14. The photosensitive drum 15 is rotated by a driving force from a drive motor (not shown), and the drive motor rotates the photosensitive drum 15 in an anti-clockwise direction in synchronous with an image forming operation. Exposure light from a scanner portion 30 is incident on the photosensitive drum 15, to selectively expose the surface of the photosensitive drum 15 to thereby form the electrostatic latent image thereon.

The developing means for visualizing the electrostatic latent image includes three color developing devices 20Y, 20M and 20C for effecting yellow (Y) color development, magenta (M) color development and cyan (C) color development, respectively, and one black developing device 21B for effecting black (B) development, and the three developing devices 20Y, 20M and 20C and the black developing device 21B have sleeves 20YS, 20MS and 20CS and a sleeve 21BS, and coating blades 20YB, 20MB, 20CB and 21BB urged against the sleeves 20YS, 20MS, 20CS and 21BS. Further, the three developing devices 20Y, 20M and 20C also include coating rollers 20YR, 20MR and 20CR.

The black developing device 21B is detachably mounted on the frame of the printer, and the color developing devices 20Y, 20M and 20C are detachably mounted on a developing rotary 23 rotated around a rotation shaft 22.

The sleeve 21BS of the black developing device 21B is disposed in a confronting relation to the photosensitive drum 15 with a small gap (for example, about 300 μm). In the black developing device 21B, toner is supplied by a toner feed member disposed within the developing device, and the toner is coated on an outer peripheral surface of the sleeve 21BS rotated in a clockwise direction by the coating blade 21BB; while charges are applied to the toner by friction charging. Further, by applying developing bias to the sleeve 21BS, the electrostatic latent image on the photosensitive drum 15 is developed to form a black toner image on the photosensitive drum 15.

Regarding three developing devices 20Y, 20M and 20C, in the image formation, the developing rotary 23 is rotated to bring a selected sleeve 20YS, 20MS or 20CS to the developing position so that the selected sleeve is opposed to the photosensitive drum 15 with a small gap of about 300 μm. In this way, the selected sleeve 20YS, 20MS or 20CS is stopped at the developing position in a confronting relation to the photosensitive drum 15, to thereby form the toner image on the photosensitive drum.

In the color image formation, whenever the intermediate transfer member 9 is rotated by one revolution, the developing rotary 23 is rotated to cause the yellow developing device 20Y, magenta developing device 20M and cyan developing device 20C to successively perform the developing operations, and then, the developing operation is performed by the black developing device 21B. In this way, while the intermediate transfer member 9 is being rotated by four revolutions, the yellow color toner image, magenta color toner image, cyan color toner image and black color toner image are successively formed, so that a full-color image is formed on the intermediate transfer member 9.

As the photosensitive drum 15 is rotated, the intermediate transfer member 9 is rotated while contacting with the photosensitive drum 15. In the color image formation, the intermediate transfer member is rotated in the clockwise direction, and four color images are transferred onto the intermediate transfer member in a superimposed fashion. In the image formation, as will be described later, a transfer roller 10 is contacted with the intermediate transfer member 9 to form a nip therebetween. While the transfer material 2 is being conveyed through the nip, the color toner images formed on the intermediate transfer member 9 are collectively transferred onto the transfer material 2 in a superimposed fashion.

The transfer roller 10 serves as a transfer charger supported for engagement and disengagement movement with respect to the intermediate transfer member 9 and is constituted by a metallic shaft and an intermediate resistance foam elastic body disposed around the metallic shaft. As shown by the solid line in FIG. 1, the transfer roller 10 is spaced apart from the intermediate transfer member 9 so as not to distort the color toner images while the color toner images are being transferred onto the intermediate transfer member 9 in the superimposed fashion. After the four color toner images were formed on the intermediate transfer member 9, in synchronous with the timing for transferring the color toner images onto the transfer material 2, the transfer roller 10 is shifted to a position shown by the broken line in FIG. 1 by a cam member (not shown). As a result, the transfer roller 10 is urged against the intermediate transfer member 9 by predetermined pressure with the interposition of the transfer material 2. At this point, by applying bias voltage to the transfer roller, the color toner images on the intermediate transfer member 9 are transferred onto the transfer material 2.

The fixing portion 25 serves to fix the color toner images onto the transfer material 2 while the transfer material is being conveyed. As shown in FIG. 1, the fixing portion includes a fixing roller 26 for heating the transfer material 2, and a pressure roller 27 for urging the transfer material 2 against the fixing roller 26. The fixing roller 26 and the pressure roller 27 are hollow cylindrical members containing heaters 28 and 29 therein, respectively. With this arrangement, the transfer material 2 bearing the color toner images thereon is conveyed by the fixing roller 26 and the pressure roller 27, and the toner is fixed to the surface of the transfer material by heat and pressure from these rollers.

After the toner images were fixed to the transfer material, the transfer material 2 is discharged onto a discharge portion 37 by pairs of discharge rollers 34, 35 and 36. In this way, the image forming operation is finished.

The cleaning means serves to remove residual toner remaining on the photosensitive drum 15 and the intermediate transfer member 9. Waste toner removed from the photosensitive drum 15 after the toner images were transferred to the intermediate transfer member 9 and waste toner removed from the intermediate transfer member 9 after the four color toner images were transferred from the intermediate transfer member 9 to the transfer material 2 are collected or accumulated into the cleaner container.

Figure 2:
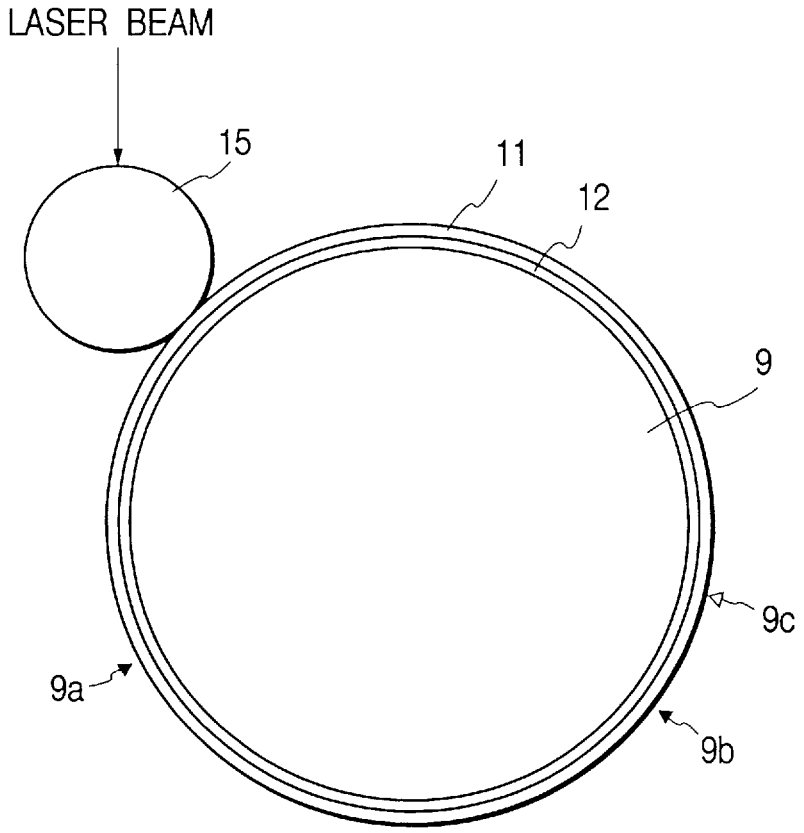
FIG. 2 is a schematic view showing an intermediate transfer member of the printer of FIG. 1.

FIG. 2 schematically shows the intermediate transfer member. The intermediate transfer member 9 is constituted by an aluminium cylinder 12 and an elastic layer 11 formed from intermediate resistance sponge or intermediate resistance rubber and coated on the aluminium cylinder. Around the intermediate transfer member 9, there are disposed an image formation start position detecting sensor (referred to as "TOP sensor" hereinafter) 9*a*, a sheet supply start timing sensor (referred to as "RS sensor" hereinafter) 9*b*, and a density sensor 9*c*.

Figure 3:
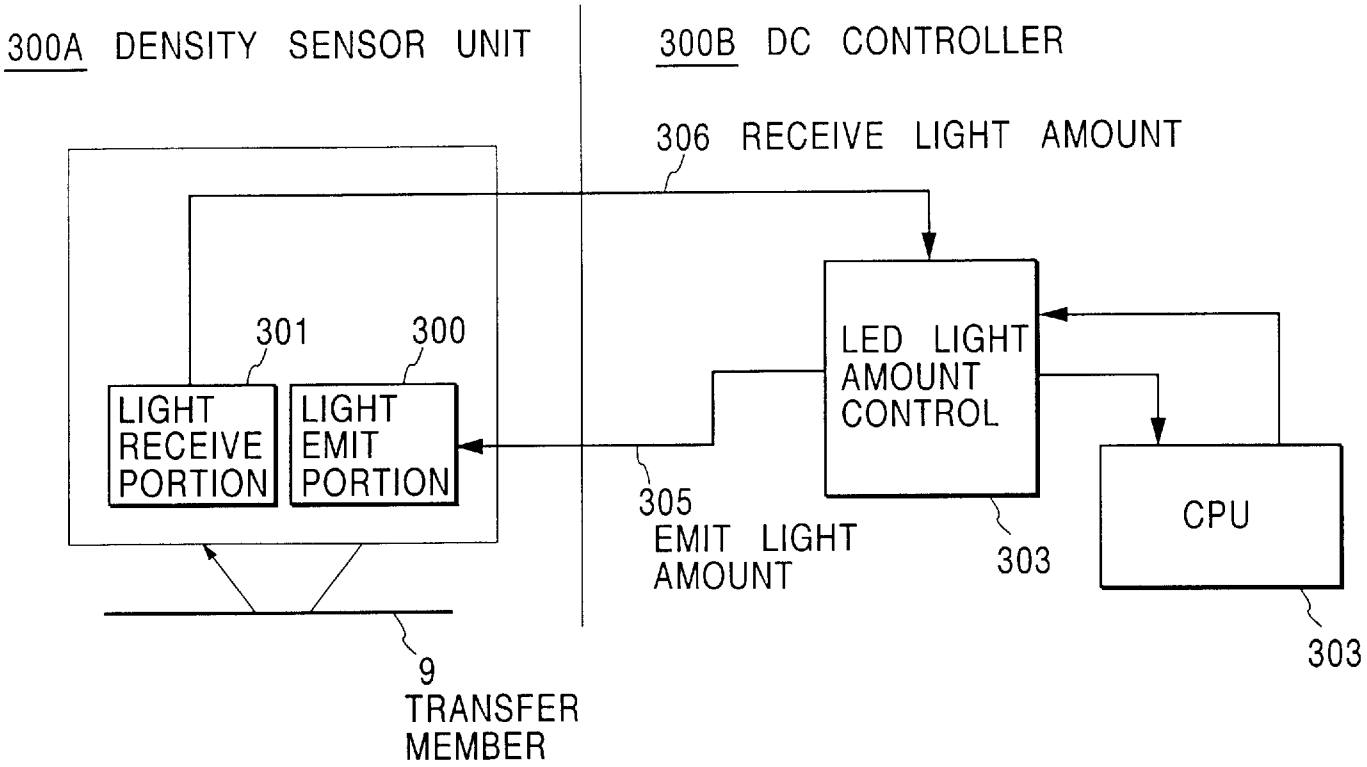
FIG. 3 is a block diagram of an image density control device according to the first embodiment.

The density sensor 9*c* is used in such a manner that, to obtain the correct color tones, densities of test toner images (for each color density detection) formed on the intermediate transfer member are measured by the density sensor and the detected results are fed-back to image forming conditions such as an exposure amount, developing bias and the like to control the density of the image, to thereby obtain the correct color image. FIG. 3 is a block diagram of an image density detection control portion using such a density sensor.

A density sensor unit 300A includes an infrared ray emit portion 300 and an infrared ray receive portion 301. Infrared rays emitted from the infrared ray emit portion 300 (referred to as "light source beam" hereinafter) Io is reflected by the surface of the intermediate transfer member 9, and the reflected light Ir is measured by the infrared ray receive portion 301. The reflected light measured by the infrared ray receive portion 301 is monitored as a receive light amount signal 306 in an LED light amount control portion 303, and an emit light amount signal 305 representing proper emit light amount is sent to the light emit portion 300 and a CPU 304. The CPU 304 calculates the density on the basis of the light source beam Io and the measured value of the reflected light Ir and performs developing bias voltage control on the basis of the calculated result.

Figure 4:
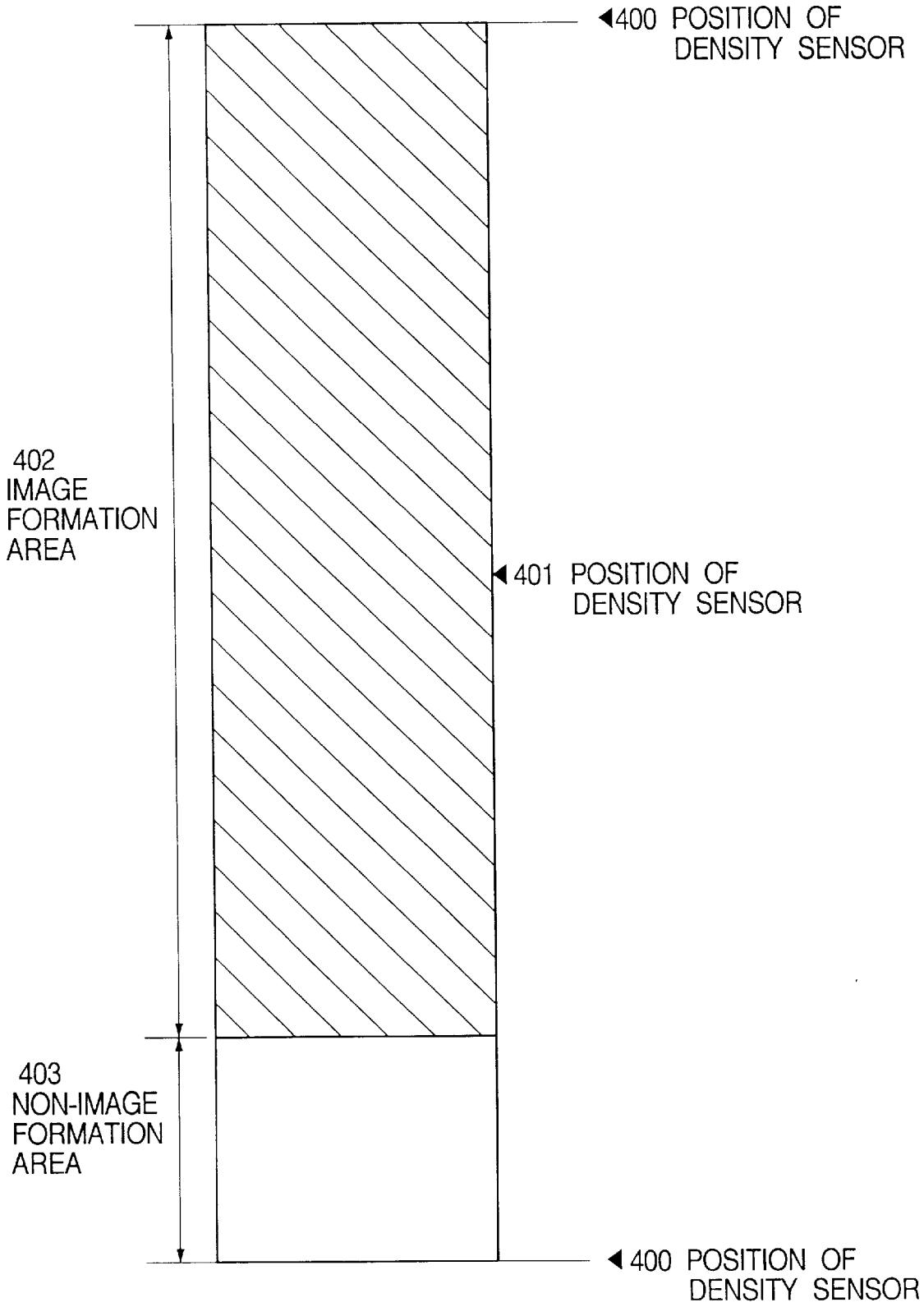
FIG. 4 is a development view of a surface of the intermediate transfer member according to the first embodiment.

FIG. 4 is a development view of the intermediate transfer member 9, sectioned at a position of the TOP sensor and developed in the rotational direction of the intermediate transfer member. The intermediate transfer member 9 has an image formation area 402 to which the color images are transferred and a non-image formation area 403 to which the color images are not transferred. After the color toner images were fixed to the transfer material, the surface of the intermediate transfer member 9 is cleaned to remove the residual toner. Since the surface of the intermediate transfer member 9 is formed from the intermediate resistance sponge or intermediate resistance rubber, the residual toner cannot be removed completely, but a small amount of toner is still remaining on the surface of the intermediate transfer member 9. Accordingly, the color of the surface of the intermediate transfer member 9 (which is initially "white") is gradually changed due to accumulation of residual toner on the image formation area by repeating the image forming operations. If the surface of the intermediate transfer member 9 is smudged or contaminated, the density control using the density sensor will become difficult, so that the correct color tones cannot be obtained.

Figure 5:
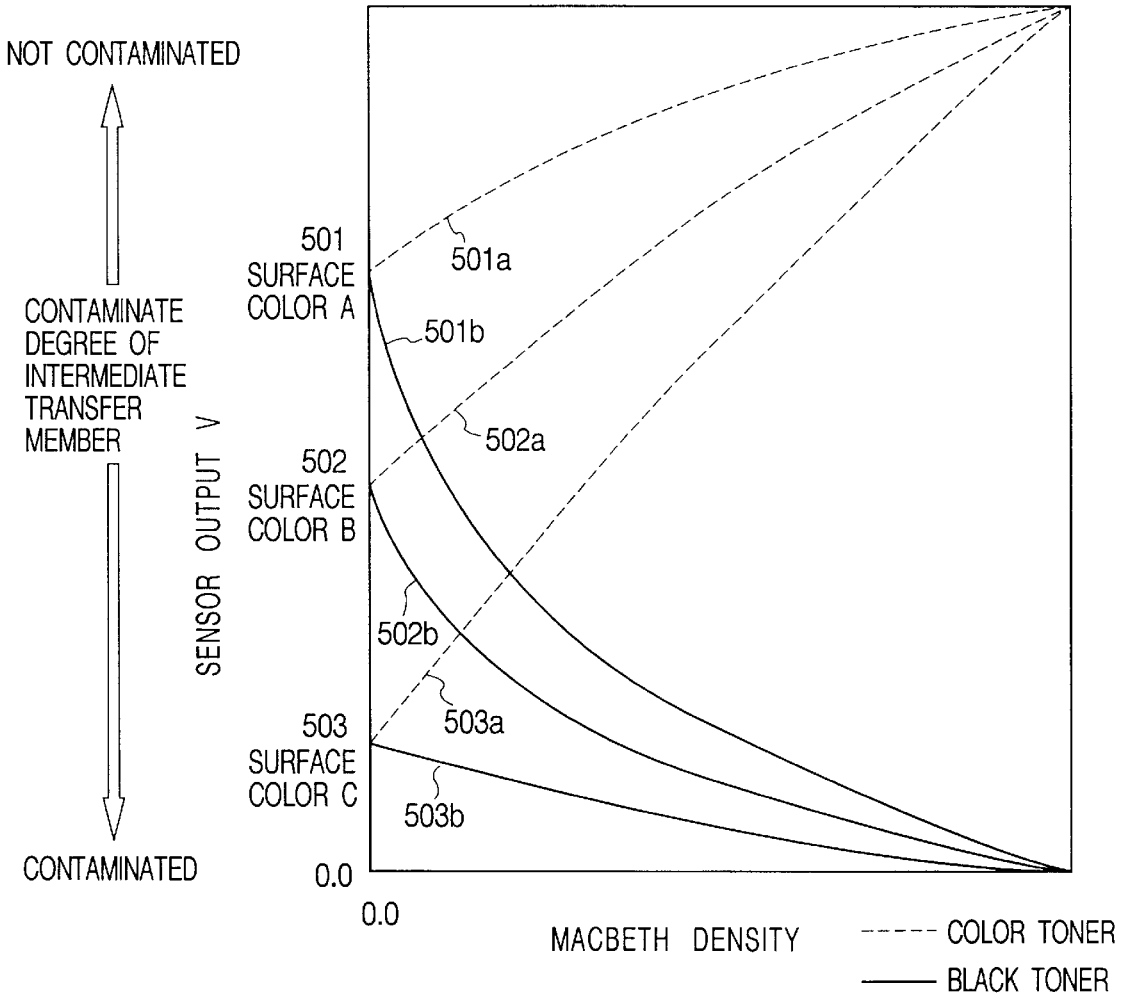
FIG. 5 is a graph showing a relation between Macbeth density and a sensor output.

FIG. 5 shows a relation between Macbeth density and performance of the density sensor 9*c* when the test toner image formed on a surface of the intermediate transfer member 9 (referred to as "surface color" hereinafter) is measured by the density sensor 9*c*.

The surface color is successively contaminated in the order of surface color A 501, surface color B 502 and surface color C 503. 501*a*, 502*a* and 503*a* indicate a relation between Macbeth density and a sensor output regarding color toner, and 501*a*, 501*b* and 501*c* indicate a relation between Macbeth density and a sensor output regarding black toner. In case of the black toner, as the contamination of the surface color is increased, the range of the sensor becomes narrower to make the correct measurement of the density of the black color toner image on the surface color difficult. In case of color toners, as the contamination of the surface color is increased, the sensor range becomes wider, which is seemed to enhance accuracy. However, in actual, since the surface color is not contaminated uniformly, the correct measurement of density is made difficult not to obtain the desired color image.

Figure 6:
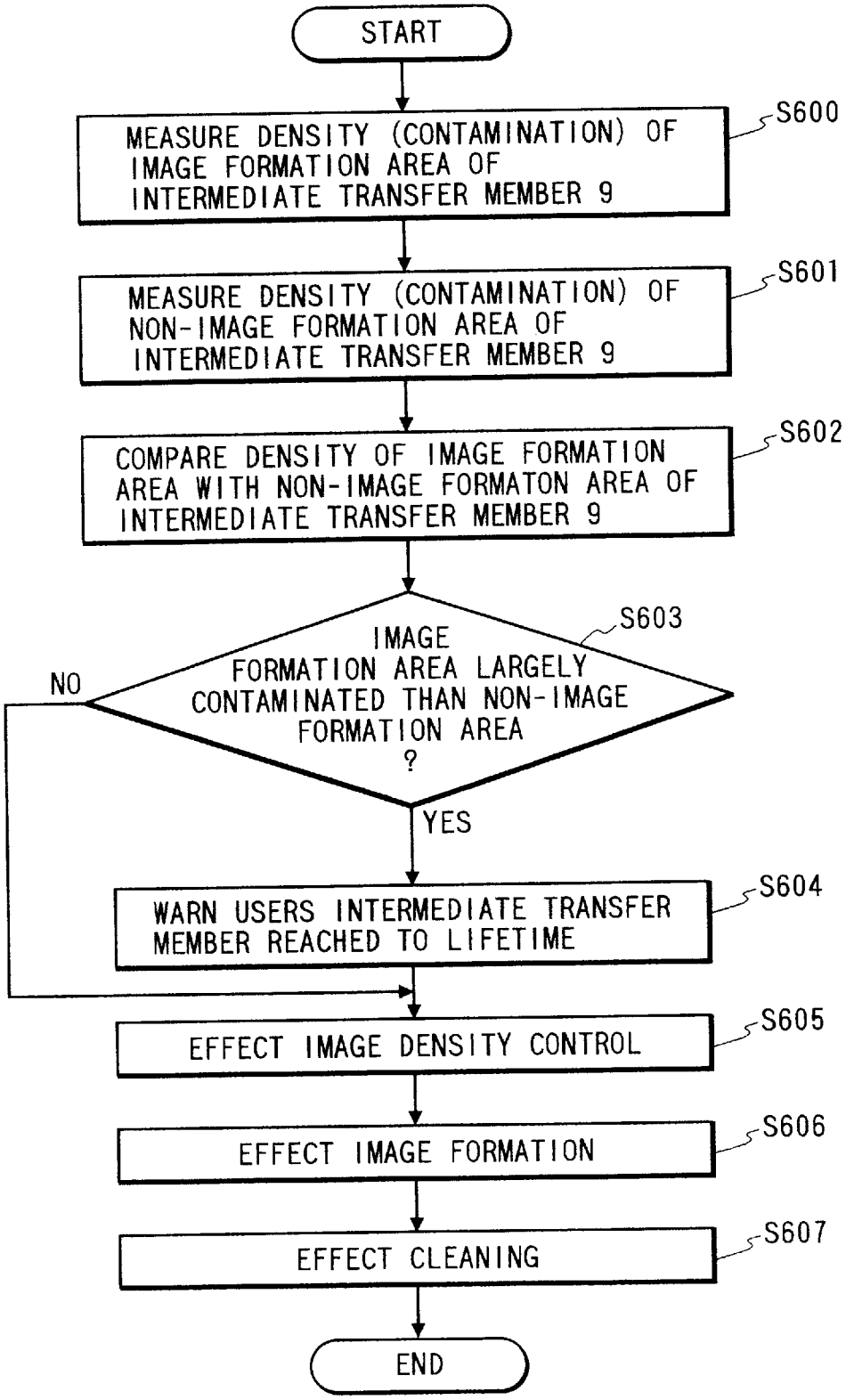
FIG. 6 is a flow chart for effecting detection of a service life of the intermediate transfer member according to the first embodiment.

In the present invention, the contamination of the surface color is measured by the density sensor 9*c* fundamentally used to perform the density control for forming the color image, and the service life of the intermediate transfer member is detected. FIG. 6 shows flow chart in which the service life of the intermediate transfer member 9 is detected by the density sensor.

When a print command signal is entered into the printer or when a power source of the printer in turned ON, the density of the surface color of the image formation area is measured to send it to the CPU 304 through the LED light amount control portion 303 (step S600). Then, the density of the surface color of the non-image formation area is measured, and measured density data is sent to the CPU 304 through the LED light amount control portion 303 (step S601). The CPU 304 judges the degree of contamination by comparing the density of the surface color of the image formation area with the density of the surface color of the non-image formation area (step S602). If the contamination reaches a predetermined service life reference of the intermediate transfer member (if difference in measured density between the contaminated portion (image formation area) and the non-contaminated portion (non-image formation area) is great), it is judged that the service life of the intermediate transfer member is expired (life time is reached) (step S603). When it is judged that the service life of the intermediate transfer member is expired, the fact that the intermediate transfer member reaches its life time is warned to the operator (step S604).

After the fact that the intermediate transfer member reaches its life time was warned to the operator, or when it is judged that the service life of the intermediate transfer member is not expired, the normal printing operation (including image density control, image formation and cleaning) is continued. Even after the fact that the intermediate transfer member reaches its life time was warned to the operator, the operator can continue to use the printer without changing the intermediate transfer member. In this case, however, the image quality obtained cannot be ensured.

[Second Embodiment]

In the above-mentioned first embodiment, an example that the densities of the surface colors of the image formation area 402 and the non-image formation area are measured and the life time of the intermediate transfer member is judged by comparing the measured results relatively was explained. To the contrary, in a second embodiment of the present invention, it is assumed that the surface color of the non-image formation area is never contaminated. In this case, the density of the surface color of the non-image formation area is used as a reference for judgement and only the surface color of the image formation area 402 is measured by the density sensor 9*c*.

The judgement of the life time of the intermediate transfer member in the second embodiment is substantially the same as that in the first embodiment shown in FIG. 6. More specifically, the density of the surface color of the image formation area is measured (step S600) to send it to the CPU. The CPU compares the measured value with the density of the surface color of the non-image formation area (reference) previously stored (steps S602 and S603), the life time of the intermediate transfer member 9 on the basis of the compared result. In this case, since measurement and treatment regarding the density of the non-image formation can be omitted, the judgement can be performed more quickly.

As mentioned above, according to the present invention, the life time of the intermediate transfer member can be judged, for example, by a simple method in which the densities of the image formation area and non-image formation area of the intermediate transfer member, so that the life time of the intermediate transfer member can be warned to the operator.

What is claimed is:

1. An image forming apparatus for forming a toner image on a transfer material by using an intermediate transfer member, said image forming apparatus comprising:

an image bearing member;

a toner image forming means for forming a toner image on said image bearing member;

an intermediate transfer member moving along an endless path while contacting with said image bearing member;

a first bias applying means for generating a first transfer bias between said image bearing member and said intermediate transfer member to effect primary transferring of the toner image formed on said image bearing member to said intermediate transfer member at a first transfer position of said intermediate transfer member;

a second bias applying means for generating a second transfre bias between said intermediate transfer member and a transfer means to effect secondary transferring of the toner image transferred to said intermediate transfer member to the transfer material at a second transfer position of said intremediate transfer member;

a measuring means for measuring a color of said intermediate transfer member;

a judge means for judging a toner contaminated condition of said intermediate transfer member on the basis of a measured result by said measuring means; and a display means for displaying a judged result by said judge means.

2. An image forming apparatus according to claim 1, wherein said measuring means also has a function for measuring density of the toner image formed on said intermediate transfer member to adjust an image forming condition.

3. An image forming apparatus for forming a toner image on a transfer material by using an intermediate transfer member, said image forming apparatus comprising:

an image bearing member;

a toner image forming means for forming a toner image on said image bearing member;

an intermediate transfer member moving along an endless path while contacting with said image bearing member;

a first bias applying means for generating a first transfer bias between said image bearing member and said intermediate transfer member to effect primary transferring of the toner image formed on said image bearing member to said intermediate transfer member at a first transfer position of said intermediate transfer member;

a second bias applying means for generating a second transfer bias between said intermediate transfer member and a transfer means to effect secondary transferring of the toner image transferred to said intermediate transfer member to the transfer material at a second transfer position of said intermediate transfer member;

a measuring means for measuring a color of said intermediate transfer member;

a judge means for judging a toner contaminated condition of said intermediate transfer member on the basis of a measured result by said measuring means; and a display means for displaying a judged result by said judge means;

wherein said measuring means detects colors of an image formation area and a non-image formation area of said intermediate transfer member to judge the toner contaminated condition of said intermediate transfer member on the basis of a difference in density between said image formation area and said non-image formation area.

4. An image forming apparatus for forming a toner image on a transfer material by using an intermediate transfer member, said image forming apparatus comprising:

an image bearing member;

a toner image forming means for forming a toner image on said image bearing member;

an intermediate transfer member moving along an endless path while contacting with said image bearing member;

a first bias applying means for generating a first transfer bias between said image bearing member and said intermediate transfer member to effect primary transferring of the toner image formed on said image bearing member to said intermediate transfer member at a first transfer position of said intermediate transfer member;

a second bias applying means for generating a second transfer bias between said intermediate transfer member and a transfer means to effect secondary transferring of the toner image transferred to said intermediate transfer member to the transfer material at a second transfer position of said intermediate transfer member;

a measuring means for measuring a color of said intermediate transfer member;

a judge means for judging a toner contaminated condition of said intermediate transfer member on the basis of a measure result by said measuring means; and a display means for displaying a judged result by said judge means;

wherein said measuring means detects a color of an image formation area of said intermediate transfer member to judge the toner contaminated condition of said intermediate transfer member on the basis of a detected value and a reference value previously stored.

5. An image forming apparatus for forming a toner image on a transfer material by using an intermediate transfer member, said image forming apparatus comprising:

an electrophotographic photosensitive member;

a toner image forming means for forming a toner image on said photosensitive member;

an intermediate transfer member moving along an endless path while contating with said photosensitive member;

a first bias applying means for generating a first transfer bias between said photosensitive member and said intermediate transfer member to effect primary transferring of the toner image formed on said photosensitive member to said intermediate transfer member at a first transfer position of said intermediate transfer member;

a second bias applying means for generating second transfer bias between said intermediate transfer member and a transfer means to effect secondary transferring of the toner image transferred to said intermediate transfer member to the transfer material at a second transfer position of said intermediate transfer member;

a measuring means for measuring a color of said intermediate transfer member;

a judge means for judging a toner contaminated condition of said intermediate transfer member on the basis of a measured result by said measuring means; and a display means for displaying a judged result by said judge means.

6. An image forming apparatus according to claim 5, wherein said measuring means includes an infrared ray emit portion and an infrared ray receive portion.

7. An image forming apparatus according to claim 5, wherein said measuring means detects colors of an image formation area and a non-image formation area of said intermediate transfer member to judge the toner contaminated condition of said intermediate transfer member on the basis of a difference in density between said image formation area and said non-image formation area.

8. An image forming apparatus according to claim 5, wherein said measuring means detects a color of an image formation area of said intermediate transfer member and to judge the toner contaminated condition of said intermediate transfer member on the basis of a detected value and a reference value previously stored.

* * * * *

UNITED STATES PATENT AND TRADEMARK OFFICE

CERTIFICATE OF CORRECTION

PATENT NO. : 5,809,365

DATED : September 15, 1998

INVENTOR(S) : Ryuichi Yoshizawa

It is certified that error appears in the above-identified patent and that said Letters Patent is hereby corrected as shown below:

COLUMN 1

Line 25, "obtaining" should read --making it impossible to obtain--, and "impossible" should be deleted.

COLUMN 5

Line 52, "flow" should read --a flow--; and
Line 56, "in" should read --is--.

COLUMN 6

Line 51, member," should read --member are compared--.

COLUMN 7

Line 5, "transfre" should read --transfer--.

COLUMN 8

Line 30, "contating" should read --contacting--.

Signed and Sealed this

Eleventh Day of May, 1999

*Attest:*

Q. TODD DICKINSON

*Attesting Officer*

*Acting Commissioner of Patents and Trademarks*